United States Patent [19]

Chen et al.

[11] Patent Number: 4,911,823

[45] Date of Patent: Mar. 27, 1990

[54] CATALYTIC CRACKING OF PARAFFINIC FEEDSTOCKS WITH ZEOLITE BETA

[75] Inventors: Nai Y. Chen, Titusville, N.J.; Thomas F. Degnan, Jr., Yardley, Pa.; Clinton R. Kennedy, Talleyville, Del.; Anil B. Ketkar, Cranbury, N.J.; Leonard R. Koenig, Mercerville, N.J.; Robert A. Ware, Wyndmoor, Pa.

[73] Assignee: Mobil Oil Corporation, New York, N.Y.

[21] Appl. No.: 352,640

[22] Filed: May 12, 1989

Related U.S. Application Data

[63] Continuation of Ser. No. 105,630, Oct. 7, 1987, abandoned, which is a continuation-in-part of Ser. No. 4,805, Jan. 12, 1987, abandoned, and a continuation-in-part of Ser. No. 825,171, Mar. 3, 1986, abandoned, and a continuation-in-part of Ser. No. 686,772, Dec. 27, 1984, abandoned.

[51] Int. Cl.[4] ..... C10G 11/05; C10G 57/00

[52] U.S. Cl. ..... 208/67; 208/49; 208/120; 585/323; 585/739

[58] Field of Search ..... 208/120, 49, 67; 585/739, 323, 446

[56] References Cited

U.S. PATENT DOCUMENTS

| | | | |
|---|---|---|---|
| 3,308,053 | 3/1967 | Kelly et al. | 208/67 |
| 3,308,069 | 3/1967 | Wadlinger et al. | 502/64 |
| 3,756,942 | 9/1973 | Cattanach et al. | 585/407 |
| 3,816,294 | 6/1974 | Wilson et al. | 208/49 |
| 3,926,781 | 12/1975 | Gale | 208/141 |
| 4,317,712 | 3/1982 | Farcasiu | 208/117 |
| 4,419,220 | 12/1983 | LaPierre et al. | 208/120 |
| 4,465,884 | 8/1984 | Degnan et al. | 585/415 |
| 4,501,926 | 2/1985 | LaPierre et al. | 208/120 |
| 4,619,758 | 10/1986 | Pratt et al. | 208/120 |
| 4,834,867 | 5/1989 | Gilson | 585/739 |

FOREIGN PATENT DOCUMENTS

| | | | |
|---|---|---|---|
| 0094827 | 11/1983 | European Pat. Off. | 208/120 |

*Primary Examiner*—Anthony McFarlane

*Attorney, Agent, or Firm*—Alexander J. McKillop; Charles J. Speciale; Malcolm D. Keen

[57] ABSTRACT

Heavy hydrocarbon oils of high paraffin content are catalytically cracked using zeolite beta. The paraffin content of the oil is at least 20 weight percent or higher. The gasoline cracking products have a high octane rating and the higher boiling products a decreased pour point resulting from the dewaxing activity of the zeolite beta. The use of cracking temperatures above 500° C., preferably above 550° C., also improves iso-butene production.

13 Claims, No Drawings

CATALYTIC CRACKING OF PARAFFINIC FEEDSTOCKS WITH ZEOLITE BETA

CROSS REFERENCE TO RELATED APPLICATIONS

This application is a continuation of Ser. No. 07/105,630, filed 10/7/87, now abandoned, which is a continuation-in-part of Ser. No. 07/004,805, filed 1/12/89, now abandoned, which is a continuation-in-part of Ser. No. 06/825,171, filed 3/3/86, now abandoned, which is a continuation-in-part of Ser. No. 06/686/772, filed 12/27/84, now abandoned. The contents of Ser. Nos. 07/004,085 and 06/686,772 are incorporated in the application by reference.

FIELD OF THE INVENTION

This invention relates to a process for the catalytic cracking of heavy oil feeds using a cracking catalysts comprising zeolite beta. It relates more particularly to a process for the catalytic cracking of paraffinic feeds with a catalyst of this type.

BACKGROUND OF THE INVENTION

The catalytic cracking of hydrocarbon oils using acidic cracking catalysts is a well established process which has, for a number of years, used a number of different types of catalytic cracking units including, in the early years, fixed bed crackers of the Houdriflow type and later, moving bed units such as the Thermofor Catalytic Cracking (TCC) units and fluidized bed catalytic cracking units (FCC). Of these, fluid catalytic cracking (FCC) has now become the predominant type of unit for catalytic cracking. In both the moving, gravitating bed and moving, fluidized bed processes, the feedstock to the unit is brought into contact with a hot, continuously circulating, cracking catalyst to effect the desired cracking reactions, after which the cracking products are separated from the catalyst which is regenerated by oxidation of the coke which accummulates on the catalyst. Oxidative regeneration in this way serves the purpose both of removing the coke which deactivates the catalyst and also brings the catalyst back up to the temperature required to maintain the endothermic cracking reactions. The hot, regenerated catalyst is then recirculated to the reactor where it is again brought into contact with the feedstock. The moving bed (TCC) process, the catalyst is generally in the form of beads which move through the reactor and the regenerator in a solid, gravitating mass whereas in the FCC process, the catalyst is in the form of a fluent powder, typically of about 100 microns particle size.

The catalysts used in catalytic cracking, whatever the type of unit employed, possess acidic functionality in order to catalyze the cracking reactions which occur. Initially, the acidic functionality was provided by amorphous type catalysts such as alumina, silica-alumina or various acidic clays. A significant improvement in the process was provided by the introduction of crystalline, zeolitic cracking catalysts in the 1960's and this type of catalyst has now become universally employed. The zeolites which are used for this purpose can generally be characterized as large pore zeolites because it is essential that the internal pore structure of the zeolite which contains the bulk of the acidic sites on the zeolite should be accessible to the bulky, polycyclic aromatic materials which make up a large portion of the heavy oil feeds to the process. Large pore zeolites which have been used for this purpose include mordenite and the synthetic faujasite zeolites X and Y. Of these, zeolite Y has now become the zeolite of choice because of its superior stability to hydrothermal degradation, particularly when it is used in the forms of a rare earth exchanged zeolite (REY) or the so-called ultrastable Y (USY).

Although most of the feeds to catalytic cracking units contain significant amounts of high boiling aromatic constituents, some feeds, particularly from Southeast Asian and Pacific sources contain relatively large amounts of waxy paraffins which are relatively refractory towards catalytic cracking, especially in the presence of aromatics. Feedstocks of this type are generally difficult to process in conventional catalytic cracking processes regardless of the type of catalyst used: when waxy gas oils derived from crudes of this type are passed through the unit, the gasoline product tends to have a relatively low octane number and the unconverted fraction in which the refractory paraffins tend to concentrate, has a very high pour point which makes it unsuitable for use as a blending component in fuel oils without the addition of cutter stock. Furthermore, recycle of the unconverted fraction is of limited utility because of the refractory nature of the paraffins in this material.

The problems presented by the presence of waxy components in petroleum oils have, of course, been known for a long time and various processes have been evolved for removing the waxy components from various distillate fractions including lubricating oils, middle distillates including heating oils and jet fuels and gas oils. Various catalytic hydro-dewaxing processes have been developed for this purpose and these processes have generally removed the longer chain n-paraffins and slightly branched chain paraffins by selectively cracking these materials to produce lower molecular weight products which may be removed by distillation. In order to obtain the desired selectivity, the catalyst has usually been an intermediate pore size zeolite with pore size which admits the straight chain n-paraffins either alone or with only slightly branched chain paraffins, but which excludes more highly branched materials, naphthenes and aromatics. Catalytic hydro-dewaxing processes of this kind are described, for example, in U.S. Pat. Nos. 3,668,113; 3,894,938; 4,176,050; 4,181,598; 4,222,855; 4,229,282; and 4,247,388. However, the intermediate pore size zeolites such as ZSM-5, which are highly effective as dewaxing catalysts in these hydrogenative processes using relative light feeds, are generally unsuitable for use as cracking catalysts because their pores are too small to admit the bulky, polycyclic aromatics into the internal pore structure of the zeolite where cracking can take place. They have not, therefore, been used as such for catalytic cracking although they have been combined with large pore zeolites in catalytic cracking catalysts in order to improve the octane rating of the naphtha cracking product, but even when combined with a conventional cracking catalyst in this way, they tend to produce too much dry gas and accordingly, they are unable to function effectively as cracking catalysts for waxy feeds. The problem of dealing with feeds of this kind has therefore persisted.

SUMMARY OF THE INVENTION

It has now been found that zeolite beta is an extremely effective cracking catalyst for highly paraffinic feeds, being capable of producing gasoline of improved octane number, with greater potential alkylate yield, and with reductions in the pour point (ASTM D-97) of the higher boiling cracking product fractions. According to the present invention, therefore, a process for the catalytic cracking of a highly paraffinic hydrocarbon oil employs a cracking catalyst comprising zeolite beta.

The feed to the cracking process may be subjected to hydrotreating in order to improve its crackability by saturating any aromatic ring structures which may be present together with ring opening of aromatics and naphthenes, according to the extent of the treatment. Initial treatment of the feed in this way permits feeds of lower paraffin content to be employed and therefore permits a greater number of feed types to be cracked to the greatest advantage. By employing severe hydrotreating, relatively aromatic feeds can be treated to increase their paraffin content to levels where the benefits of the present process become apparent.

It has also been found that the use of relatively high cracking temperatures, typically greater than about 500° C. (about 930° F.) and preferably above about 550° C. (about 1020° F.), the proportion of isobutene in the cracking products is significantly increased. This finding is of particular utility when octane-improving additives such a methyl tertiary butyl ether (MTBE) are to be produced because iso-butene is a key starting material in their production.

DETAILED DESCRIPTION

General Considerations

The present catalytic cracking process is applicable to the catalytic cracking of highly paraffinic feeds, that is, to feeds which comprise at least 20% by weight paraffins. The process may be carried out in any of the conventional type of catalytic cracking units, implying that it will normally be carried out in a moving, gravitating bed (TCC) unit or a fluidized bed (FCC) catalytic cracking unit in the absence of added hydrogen. Because both the FCC and TCC processes are well established, it is not necessary to describe their individual features in detail, except to point out that both are endothermic catalytic cracking processes which are operated at elevated temperatures, typically in excess of about 550° C. (about 1020° F.) usually under slight superatmospheric pressure in the reactor. The catalyst passes continuously in a closed loop from the cracking reactor to the regenerator in which the coke which accummulates on the catalyst is removed oxidatively, both in order to restore activity to the catalyst and to supply heat for the endothermic cracking requirements. The oxidative regeneration is carried out in a bed of the same general type as the reactor bed so that in a TCC process, regeneration is carried out in a moving, gravitating bed in which the catalyst particles move downwards countercurrent to the flow of regeneration gas and in the various FCC processes, regeneration is carried out in a fluidized bed, typically using a dense phase bed or a combination of dense phase bed with a dilute phase transport bed, according to the unit. Typical FCC processes are disclosed in U.S. Pat. Nos. 4,309,279; 4,309,280; 3,849,291; 3,351,548; 3,271,418; 3,140,249; 3,140,251; 3,410,252; 3,140,253; 2,906,703; 2,902,432; regeneration techniques applicable to FCC are disclosed, for example, in U.S. Pat. Nos. 3,898,050, 3,893,812 and 3,843,330 to which reference is made for a description of particular details of such processes.

In general, the present catalytic cracking process will be carried out under conditions comparable to those used in existing processes, having regard to the capabilities of the cracking unit, the exact composition of the feed and the type and distribution of the products which are desired. As is well known, some feeds are more refractory than others and require the use of higher temperatures and changes in the distribution of the products, for example, depending upon whether the production of naphtha or of distillate is to be maximized, will require other changes. Other changes in operating conditions may be required according to the catalyst circulation rate—a factor which is characteristic of the unit—and catalyst makeup rate. The extent to which changes in these operating conditions will affect the products obtained in any given unit will be known for that unit.

Feedstocks

Feedstocks which are used in the present process are highly paraffinic petroleum fractions, that is, petroleum fractions which contain at least 20% by weight of waxy components. The waxy components will comprise normal paraffins and slightly branched chain paraffins with only minor degrees of short-chain branching, e.g. mono-methyl paraffins. In some cases, the petroleum fraction will contain at least 40% or even at least 60 wt. % of waxy components and indeed, the ability of the present catalysts to handle very highly paraffinic feeds enable certain refinery streams which are almost exclusively paraffinic, such as slack wax, to be cracked effectively to produce products of higher value. The presence of waxy components implies, of course, that the petroleum fraction has an initial boiling point which places the molecular weights of the paraffins in a range where they will be waxy in nature. This normally means that the fraction will have an initial boiling point above that of the naphtha boiling range materials, e.g. above about 200° C. (about 390° F.) and more usually the initial boiling point will be above about 300° C. (about 570° F.). In most cases, the initial boiling point of the fraction will be at least 345° C. (about 650° F.). In most cases, the end point will not be higher than 565° C. (about 1050° F.) although higher end points may be encountered, depending upon the distillation units being used in advance of the cracker although they may include significant amounts of heavy ends which are essentially non-distillable. Generally, therefore, the feedstocks which are used in the present process will have a boiling range within the range of 345° to 565° C. (about 650° to 1050° F.) although other boiling ranges, e.g. 300°-500° C. may also be encountered. The feeds can therefore be generally characterized as gas oils, including vacuum gas oils although other highly paraffinic refinery streams such as slack wax may also be catalytically cracked using the present catalysts.

The feeds will usually contain varying amounts of aromatic compounds, generally polycyclic aromatics with alkyl side chains of varying lengths which will be removed during the cracking process. However, certain feeds may be so highly paraffinic that the content of aromatics will be quite small, for example, in the slack waxes mentioned above. Naphthenes will also generally be present in varying amounts, depending upon the nature of the feed and its processing prior to the catalytic cracking step. In general, the feedstocks will not contain unusually large amounts of aromatics.

The feed may be subjected to various treatments prior to cracking, either to improve the cracking operation by providing a feed of improved crackability or to improve the distribution of the products or their properties. Hydrotreating of the feed is a particulary useful adjunct because it removes heteroatom-containing impurities and saturates aromatics; in doing so, it reduces catalyst poisoning by the heteroatom contaminants, especially nitogen and sulfur, reduces the $SO_x$ emissions from the unit and, in increasing the hydrogen content of the feed to a level which approaches that of the products, improved product distribution and feed crackability. Severe hydrotreating to reduce aromatic unsaturation by hydrogenation and ring opening is a particularly useful technique since it enables the advantages of the present process to be achieved with feeds which are initially less paraffinic. Conventional hydrotreating catalysts and conditions may be used, with higher hydrogen pressures preferred with feeds of higher aromaticities in order to increase aromatics saturation.

The compositions of two typical, waxy gas oil feeds are set out in Tables 1 and 2 below; of two hydrotreated feeds in Tables 3 and 4 and of four slack wax feeds in Table 5. These feeds, either on their own or with other feeds may be used in the present process.

TABLE 1

| Minas Gas Oil | |
|---|---|
| Nominal boiling range, °C. (°F.) | 345°-540° (650°-1000°) |
| API Gravity | 33.0 |
| Hydrogen, wt % | 13.6 |
| Sulfur, wt % | 0.07 |
| Nitrogen, ppmw | 320 |
| Basic Nitrogen, ppmw | 160 |
| CCR | 0.04 |
| Composition, wt % | |
| Paraffins | 60 |
| Naphthenes | 23 |
| Aromatics | 17 |
| Bromine No. | 0.8 |
| KV, 100° C., cSt | 4.18 |
| Pour Point, °C. (°F.) | 46 (115) |
| 95% TBP, °C. (°F.) | 510 (950) |

TABLE 2

| Gippsland Gas Oil | | |
|---|---|---|
| API Gravity | 33.8 | |
| Pour Point, °C. (°F.) | 40 (105) | |
| KV at 100° C., cSt | 3.0 | |
| Aniline Point, °C. (°F.) | 95 (202.5) | |
| Bromine Number | 1.7 | |
| Refractive Index at 70° C. | 1.4538 | |
| Hydrogen, wt % | 13.67 | |
| Sulfur, wt % | 0.15 | |
| Nitrogen, ppm | 180 | |
| Nickel, ppm | 0.14 | |
| Vanadium, ppm | 0.10 | |
| Iron, ppm | 2.0 | |
| Copper, ppm | *0.1 | |
| Conradson Carbon, wt % | 0.13 | |
| Molecular Weight, av. | 313 | |
| Composition, wt % | | |
| Paraffins | 62.9 | |
| Mononaphthenes | 1.6 | |
| Polynaphthenes | 10.7 | |
| Aromatics | 24.7 | |
| Distillation (D-1160) | °C. | °F. |
| IBP | 205 | 401 |
| 5% | 280 | 537 |
| 10% | 309 | 589 |
| 30% | 367 | 693 |
| 50% | 396 | 745 |
| 70% | 420 | 789 |
| 90% | 457 | 855 |
| 95% | 474 | 886 |
| EP% | 485 | 905 |

*Less Than

TABLE 3

| HDT Minas Feed | |
|---|---|
| Nominal boiling range, °C. (°F.) | 345°-540° (650°-1000°) |
| API Gravity | 38.2 |
| H, wt. pct. | 14.65 |
| S, wt. pct. | 0.02 |
| N, ppmw | 16 |
| Pour Point, °C. (°F.) | 38 (100) |
| KV at 100° C., cSt | 3.324 |

TABLE 4

| HDT Statfjord Feed | |
|---|---|
| Nominal boiling range, °C. (°F.) | 345°-455° (650°-850°) |
| API Gravity | 31.0 |
| H, wt. pct. | 13.76 |
| S, wt. pct. | 0.012 |
| N, ppmw | 34 |
| Pour Point, °C. (°F.) | 32 (90) |
| KV at 100° C., cSt | 4.139 |
| Composition, wt % | |
| Paraffins | 30 |
| Naphthenes | 42 |
| Aromatics | 28 |

TABLE 5

| Slack Wax Composition - Arab Light Crude | | | | |
|---|---|---|---|---|
| Composition, wt % | A | B | C | D |
| Paraffins | 94.2 | 81.8 | 70.5 | 51.4 |
| Mono-naphthenes | 2.6 | 11.0 | 6.3 | 16.5 |
| Poly-naphthenes | 2.2 | 3.2 | 7.9 | 9.9 |
| Aromatics | 1.0 | 4.0 | 15.3 | 22.2 |

Cracking Catalyst

The cracking catalyst used in the present process comprises zeolite beta as its essential cracking component. Zeolite beta is a known zeolite which is described in U.S. Pat. Nos. 3,308,069 and RE 28,341, to which reference is made for a description of this zeolite, its method of preparation and its properties.

Zeolite beta may be synthesized with relatively high silica:alumina ratios, for example, in excess of 100:1 and it is possible to achieve even higher ratios by thermal treatments including steaming and acid extraction, and in this was it is possible to make highly siliceous forms of the zeolite with silic:alumina ratios ranging from the lowest ratio at which the zeolite may be synthesized up to 100:1, 1,000:1, 30,000:1 or even higher. Although these forms of the zeolite would be capable of being used in the present process, the fact that catalytic cracking requires the catalyst to possess a relatively high degree of acidity, generally implies that the more acidic materials, with silica:alumina ratios from about 15:1 to 150:1 will be preferred with ratios from 30:1 to about 70:1 giving very good results. Because zeolite beta may be synthesized relatively easily with silica:alumina ratios of this magnitude, the zeolite may generally be used in its as-synthesized form, following calcination to remove the organic cations used in its preparation. For similar reasons, it is generally preferred not to incorporate substantial amounts of alkali or alkaline earth metal cations into the zeolite, as disclosed in U.S. Pat. No. 4,411,770, because these will generally decrease the acidity of the material. If lower acidity should be desired, however, it is normally preferred to secure it by using zeolite forms of higher silica:alumina ratio rather than by adding alkali or alkaline earth metal cations to counter the acidity, because the more highly siliceous forms of the zeolite tend to be more resistant by hydrothermal degradation. Acid extraction is a preferred method of dealuminzation either on its own or with preliminary steaming; dealuminized catalysts made in this way have been found to have improved distillate (G/D) selectivity.

The acidic functionality of the zeolite at the time that it is used as fresh catalyst in the process, is typically in excess of about 0.1, as measured by the alpha activity test, with preferred alpha activities being in the range of from 1 to 500 or even higher, and more commonly in the range of 5 to 100. The method of determining alpha is described in U.S. Pat. No. 4,016,218 and in *J. Catalysis*, VI, 278–287 (1966), to which reference is made for a description of the method. However, it should be remembered that the initial alpha value will be relatively rapidly degraded in a commercial catalytic cracking unit because the catalyst passes repeatedly through steam stripping legs to remove occluded hydrocarbons and in the regeneration process, a considerable amount of water vapor is released by the combustion of the hydrocarbonaceous coke which is deposited on the zeolite. Under these conditions, aluminum tends to be removed from the framework of the zeolite, decreasing its inherent acidic functionality.

Zeolite beta may be synthesized with trivalent framework atoms other than aluminum to form, for example, borosilicates, boroaluminosilicates, gallosilicates or galloaluminosilicate structural isotypes. These structural isotypes are considered to constitute forms of zeolite beta, the term zeolite beta being used to refer to materials of ordered crystalline structure possessing the characteristic X-ray diffraction of zeolite beta. The zeolite may be partially exchanged with certain cations in order to improve hydrothermal stability, including rare earths and Group 1B metals such as samarium, lanthanum, cerium, neodymium, praseodymium, silver or copper.

The zeolite beta is capable of catalyzing the desired cracking reactions on its own but in order to resist the crushing forces and attrition which are encountered in a commercial catalytic cracking unit, it will generally be formulated with a matrix or binder in order to improve its crushing strength and attrition resistance. The zeolite will therefore generally be incorporated in a clay or other matrix material such as silica, alumina, silica/alumina or other conventional binders. The binder material imparts physical strength to the catalyst particle and also enables the density of the catalyst particles to be regulated for consistent fluidization in FCC units. Generally, the amount of zeolite in the catalyst particles will be in the range of 5 to 95 wt. percent, with amounts from 10 to 60 wt. percent being preferred.

The binder may, and usually does, have some significant catalytic activity of its own but it will generally be preferred that the total acidic functionality provided by the binder will be only a minor amount of the total catalyst activity, as determined by the alpha test, because it is the zeolite which provides the particular, selective cracking characteristics which are desired with the paraffinic feeds.

Because catalytic cracking, which is generally carried out in the absence of added hydrogen, does not require the presence of a hydrogenation-dehydrogenation component as does hydrocracking, there is no need for any such component in the present cracking catalysts. Nevertheless, metal components may be present for other purposes, notably to promote the oxidation of carbon monoxide to carbon dioxide in the regenerator, as described in U.S. Pat. Nos. 4,473,658; 4,350,614; 4,174,272; 4,159,239; 4,093,568; 4,072,600; 4,541,921; 4,435,282; 4,341,660 and 4,341,623 to which references is made for a description of the use of oxidation promotors for this purpose. Typical oxidation promotors are the noble metals, especially platinum, and generally they will be present, if at all, in amounts which do not exceed 1,000 ppmw, preferably not more than 500 ppmw with about 100 ppmw being a typical maximum. In certain cases, extremely small amounts of promotor down to 0.1 ppmw may be sufficient and amounts of 0.1–100 ppmw are by no means uncommon. The oxidation promotor may be present on the catalyst or as a separate component.

Other zeolites in addition to the zeolite beta may be present in the catalyst and generally these will be other conventional cracking catalysts such as zeolite Y or intermediate pore size zeolites such as ZSM-5 which may be present to obtain further improvements in the octane number of the napththa cracking products. Generally, if other zeolites are present in the catalyst for the purpose of octane improvement, they will be used in amounts less than that of the zeolite beta, for example, usually less than 50 wt. percent of the amount of the zeolite beta and typically from 10 to about 30 percent by weight of the zeolite beta, as described, for example, in U.S. Pat. Nos. 3,769,202, 3,758,403, 3,894,931, 3,894,933, and 3,894,934, although even smaller amounts, for example, 0.1 to 0.5 wt. percent may be used, as described in U.S. Pat. No. 4,309,279, to which reference is made for a description of the use of intermediate pore zeolites in cracking catalysts for this purpose. Copending application Ser. No. 775,189, filed 12 September 1985, discloses a process for catalytic cracking with mixtures of faujasite-type zeolites and zeolite beta.

When the catalyst is to be used in a moving bed process, it will usually be formed into pills, extrudates or oil-dropped spheres with an equivalent particle diameter of 1/32 to ¼ inch, preferably about ⅛ inch (about 1 to 6 millimeters, preferably about 2 millimeters). When the catalyst is intended for use in a fluid catalytic cracking process, it will usually be used in the form of a fine powder, typically of 10 to 300 microns particle size, typically about 100 microns.

Process Conditions

As mentioned above, the catalytic cracking process is an endothermic process which is carried out under high temperatures, with the heat required for the process supplied by the oxidation of the carbon (coke) which accummulates on the catalyst during the cracking part of the cycle. Thus, the process as a whole, including the regeneration, is operated in a heat-balanced mode, with the regenerated catalyst serving as the medium for transferring the heat produced in the regenerator to the endothermic cracking process. Each cracking unit will have its own particular operating characteristics, as noted above, and these will determine the exact conditions used in the unit. Generally, however, the conditions will be characterized as being of elevated temperature, typically in excess of about 550° C. (about 1020°

F.) and frequently even higher, although temperatures above about 760° C. (about 1400° F.) are infrequently encountered because they tend to cause sintering of the catalyst and are close to the metallurgical limits on most units. In riser type crackers, the quoted temperatures will be those prevailing at the top of the riser. Pressures, as noted above, are usually only slightly above atmospheric typically up to about 1000 kPa (abs.) (about 130 psig), more commonly up to about 500 kPa (abs.) (about 58 psig). Catalyst/oil ratios will generally be in the range 0.1–10, more commonly 0.2–5 (by weight, catalyst:oil).

Conversion, that is, the proportion of the feed converted to lower boiling products, is a significant process parameter and generally will be at least 50 percent by weight. So, in a 345° C.+ (about 650° F.+) gas oil, at least 50 percent by weight of the feed will be converted to fractions boiling below 345° C. (about 650° F.). Usually, conversion will be in the range 50–80 percent or even higher, up to 90 weight percent. It may, however, be necessary to limit conversion because of downstream limitations, especially distillation capacity. One characteristic of the present process using highly paraffinic feedstocks with the zeolite beta cracking catalyst is that large quantities of light olefins are produced and although these are desirable because they can be converted to high octane naphtha in conventional alkylation units, the fractionators connected to the cracking unit may not be large enough to handle these quantities of light olefins.

If the cracking feed is contacted with the catalyst at relatively high temperatures, usually over about 500° C. (about 930° F.) and preferably above about 550° C. (about 1020° F.), the cracking products contain increased proportions of iso-butene, a key ingredient for the production of branched chain ether octane improvers such as MTBE as well as an alkylation feed. This represents a significant improvement since the yield of iso-butene from catalytic cracking operations is usually quite low.

Process Characteristics

In use, zeolite beta has shown itself to be a stable cracking catalyst which, especially in its dealuminized forms with higher silica:alumina ratios, has good hydrothermal stability and in this respect has good potential for use in comercial cracking units in which the catalyst circulates through steam stripping zones and is subjected to water vapor at high temperature during the regeneration. In addition, zeolite beta is notable for its ability to crack paraffins in preference to aromatics and it is the n-paraffins which are cracked in preference to iso-paraffins. Zeolite Y, by contrast, is more selective towards naphthenes and aromatics so that highly paraffinic stocks have been considered refractory towards cracking with this zeolite. Zeolite beta is well able to convert these materials to lower boiling products but if significant quantities of aromatics are present with a correspondingly lower paraffin content, the use of a mixed catalyst comprising zeolite beta and a faujasite type zeolite may be desirable, as described in co-pending application Ser. No. 775,189, to which reference is made for a description of a process using combination cracking catalysis of this type.

By preferentially cracking the waxy paraffins in the feed, zeolite beta effectively dewaxes the feed, so producing a lowering of the pour point in the unconverted fraction, e.g. the 345° C.+ (about 650° F.+) fraction. The present cracking process may therefore be employed for non-hydrogenative gas oil dewaxing in circumstances where an aromatic product is acceptable. At higher conversion levels, typically greater than 60 or 70 weight percent, further lowering of the pour point in the unconverted fraction may be noted, indicating a preference for conversion of the higher molecular weight components. Although zeolite beta has a distillate selectivity comparable to that of dealuminized zeolite Y at comparable silica:alumina ratios, it has been found that as the paraffin content of the feed increases, zeolite beta becomes progressively more effective in removal of the waxy paraffinic components, as indicated by the pour point of the unconverted fraction.

The dewaxing of the unconverted fraction enables the end point of distillate fractions which are pour point limited to be extended. For example, it is possible to extend the light fuel oil (LFO) fraction into the 345° C.+ (about 650° F.+) range because of the dewaxing effect of the catalyst, thereby enlarging the size of the LFO pool. Similarly, the pour point reduction of the 345° C.+ (650° F.+) fraction may permit the end point of heavy fractions, e.g. heavy fuel oil (HFO) to be extended.

Another particular advantage of zeolite beta is that it produces an improvement in the octane rating of the gasoline boiling range product (approx. $C_5$–165° C., $C_5$–330° F.). Improvements of at least 2 and typically of 3 to 5 octane numbers (R+O) may be noted with cracking of highly paraffinic feeds over zeolite beta, as compared to cracking over conventional cracking catalysts based on zeolite Y. Octane ratings in excess of 90 (R+O) may be achieved. Furthermore, when the octane contribution from the alkylate fraction is considered, the improvement is even more marked: zeolite beta produces larger quantities of alkylate with a higher $C_4/C_3$ olefin ratio than zeolite Y and the yield of gasoline plus alkylate is accordingly higher for zeolite beta than for zeolite Y. These characteristics make for a higher alkylate yield and alkylate quality for a further improvement in gasoline quality. Octane quality of the naphtha and of the alkylate is relatively constant with conversion although slight increases do occur at higher conversion levels, as is customary. Finally, the coke yield with zeolite beta is lower than with zeolite Y at comparable conversion levels.

EXAMPLES 1–4

These Examples compare the performance of two different cracking catalysts on two different feeds. One catalyst was a conventional catalyst based on zeolite Y and the other is based on zeolite beta.

The conventional catalyst was a sample of equilibrium Durabead 9A (tradmark), a moving bed catalytic cracking catalyst removed from an operating refinery. It consisted of a conventional 12 wt.percent REY zeolite in a silica/alumina binder in bead form.

The zeolite beta catalyst consisted of 50 wt. percent zeolite beta (zeolite/silica/alumina ratio of 40:1, alpha activity of 400 in the hydrogen form) and 50 wt. percent alumina binder mixed together and extruded. The catalyst was dried and calcined for 3 hours at 540° C. (1000° F.) in nitrogen followed by 3 hrs. at 540° C. (1000° F.) in air. The sodium content of the catalyst was 495 ppm. The zeolite beta catalyst was then steamed at 700° C. (1290° F.) for 4 hrs., in 100% steam at atmospheric pressure to an alpha activity of 6.

The two catalysts were then tested for the catalytic cracking of two different gas oil feeds, whose properties are shown in Table 6 below.

TABLE 6

| Gas Oil Properties | Gas Oil A | Gas Oil B |
|---|---|---|
| API Gravity | 23.7 | 32.9 |
| Pour Point, °C. °F. | 35 (95) | 40 (105) |
| Aniline Point, °F. | 71 (160) | 94 (202) |
| Sulfur, wt % | 0.51 | 0.15 |
| Nitrogen, ppmw | 1600 | 200 |
| Nickel, ppmw | 0.53 | 0.14 |
| Vanadium, ppmw | 0.24 | 0.10 |
| Molecular Weight, av. | 357 | 320 |
| Paraffins, wt. % | 16.4 | 62.2 |
| Naphthenes, wt. % | 37.8 | 13.6 |
| Aromatics, wt. % | 45.8 | 24.2 |

As is apparent, Gas Oil B is considerably more paraffinic than Gas Oil A.

The catalysts were each placed in a laboratory sized, fixed-bed cracking unit which simulates moving bed cracking and used to crack the two gas oil feeds. The conditions used and the results obtained are given in Tables 7 and 8 below.

TABLE 7

| Cracking Aromatic Gas Oil (Gas Oil A) | | |
|---|---|---|
| Example | 1 | 2 |
| Catalyst | Zeolite Beta | Zeolite Y |
| Temperature °C. (°F.) | 496 (925) | 496 (925) |
| Cat/Oil (g. zeolite/g. oil) | 0.38 | 0.36 |
| Run Time (minutes) | 10 | 10 |
| Conversion, (vol %) | 53 | 53 |
| $C_5$ + Gasoline (vol %) | 41.6 | 44.7 |
| Total $C_4$'s (vol %) | 8.8 | 6.5 |
| Dry Gas (wt %) | 5.4 | 4.6 |
| Coke (wt %) | 3.4 | 3.6 |
| Octane (R + O) | 91.7 | 91.1 |
| $C_3$ = (vol %) | 4.7 | 2.6 |
| $C_4$ = (vol %) | 5.2 | 2.5 |
| iso-$C_4$ (vol %) | 2.9 | 3.1 |
| Alkylate (vol %) | 16.6 | 8.5 |
| Alkylate (R + O) | 94.1 | 93.6 |
| Gasoline + Alky (vol %) | 58.2 | 53.2 |
| Gasoline + Alky Octane (R + O) | 92.4 | 91.5 |

TABLE 8

| Cracking Paraffinic Gas Oil - Gas Oil B | | |
|---|---|---|
| Example | 3 | 4 |
| Catalyst | Zeolite Beta | Zeolite Y |
| Temperature °C. (°F.) | 496 (925) | 496 (925) |
| Cat/Oil (g. zeolite/g. oil) | 0.37 | 0.49 |
| Run Time (minutes) | 5 | 5 |
| Conversion, (vol %) | 60 | 60 |
| $C_5$ + Gasoline (vol %) | 42.2 | 45.5 |
| Total $C_4$'s (vol %) | 17.0 | 13.0 |
| Dry Gas (wt %) | 7.6 | 6.5 |
| Coke (wt %) | 2.0 | 2.5 |
| Octane (R + O) | 90.2 | 86.0 |
| $C_3$ = (vol %) | 8.2 | 5.3 |
| $C_4$ = (vol %) | 11.1 | 5.3 |
| iso-$C_4$ (vol %) | 4.8 | 6.2 |
| Alkylate (vol %) | 32.8 | 18.5 |
| Alkylate (R + O) | 94.1 | 93.9 |
| Gasoline + Alky (vol %) | 75.0 | 64.0 |
| Gasoline + Alky Octane (R + O) | 91.9 | 88.3 |
| LFO, vol % 215°-345° C. (420°-650° F.) | 23.3 | 22.5 |
| HFO, vol % 345° C.+ (650° F.+) | 16.7 | 17.5 |
| LFO pour pt., °C. (°F.) | −4 (25) | 2 (35) |
| HFO pour pt., °C. (°F.) | 35 (95) | 46 (115) |

As shown in Tables 7 and 8, zeolite beta provides only marginal benefits over the conventional zeolite Y cracking catalyst when relatively non-paraffinic feeds such as Gas Oil A are used. Although the octane number of the gasoline produced is about the same, the zeolite beta cracking produces a 0.9 higher gasoline and alkylate octane number and 5 vol. percent higher gasoline and alkylate. These benefits increase substantially when the feed is highly paraffinic. As shown in Table 8, zeolite beta cracking of the paraffinic Gas Oil B results in the production of significantly more gasoline plus alkylate (75.0 vol. percent, as compared to 64.0 vol. percent). Furthermore, the improved pour points of the heavier fractions are notable, as are the reduced coke yields and the higher yields of gasoline plus alkylate.

Somewhat surprisingly, the octane number of the gasoline and alkylate fraction produced by zeolite beta cracking is also significantly higher, a gasoline plus alkylate octane number (R+O) of 91.9 as compared to the 88.3 (R+O) of the gasoline and alkylate produced from zeolite Y catalytic cracking. Thus, the zeolite beta produced not only more gasoline, but gasoline with a higher octane number than the commercially used catalyst based on zeolite Y.

EXAMPLES 4–13

In these Examples, two catalysts were tested on three different waxy gas oils of high paraffin content.

The first catalyst was a dealuminized zeolite Y catalyst prepared by the acid extraction of ultrastable zeolite Y (USY) using 1.0M HCl, followed by steaming at 650° C. (1200° F.) at atmospheric pressure in 100% steam for 24 hours. The final, steamed zeolite had a framework silica:alumina ratio of 226:1, as determined by temperature programmed ammonia desorption (TPAD).

The second catalyst was a calcined zeolite beta catalyst (30:1 silica:alumina) which had been subjected to the same steaming treatment (no acid extraction) to increase the framework silica:alumina ratio to about 228:1, as determined by TPAD. The TPAD analysis procedure used is described in the article by G. T. Kerr and A. W. Chester in *Thermochim. Acta.* 3, 113 (1971).

The catalysts were used for the fluidized bed cracking of the three gas oils described below, using a small scale, dense fluidized bed reactor operated in a cyclic mode to give 10 minutes cracking and 5 minutes helium purge followed by oxidative regeneration to completion (40% oxygen:60% nitrogen), with a final 1 minute helium purge. The catalyst was used in the form of the pure zeolite (50 cc) crushed to 60–80 mesh (U.S. Standard), mixed with 30 cc of acid-washed, calcined quartz chips (80–120 mesh, U.S. Standard, "Vycor"—trademark). Comparison runs to show the extent of thermal cracking were carried out with 80 cc of crushed "Vycor" chips. The reaction temperature in each case was 510° C. (950° F.) with space velocity (LHSV) varying from 1.5 to 12 $hr^{-1}$. Product was accummlated over a series of 10 cycles; mass balances in all cases were greater than 95%. All products were analyzed by gas chromatograph.

The properties of the three heavy vacuum gas oils (HVGO) used in these experiments are given in Table 9 below.

TABLE 9

| Properties of Heavy Vacuum Gas Oils | HVGO-C | HVGO-D | HVGO-E |
|---|---|---|---|
| C (wt. %) | 85.65 | 85.82 | 81.50 |

TABLE 9-continued

| Properties of Heavy Vacuum Gas Oils | HVGO-C | HVGO-D | HVGO-E |
|---|---|---|---|
| H (wt. %) | 12.13 | 12.67 | 13.28 |
| O (wt. %) | 0.30 | — | — |
| N (wt. %) | 0.09 | 0.0169 | 0.01 |
| S (wt. %) | 2.15 | 0.22 | 0.03 |
| Ash (wt. %) | 0.01 | — | — |
| Ni (ppm) | 0.5 | *0.01 | *1 |
| V (ppm) | 0.5 | 0.5 | *1 |
| CCR | 0.44 | | |
| Pour Point, °C. (°F.) | 32 (90) | 43 (110) | 57 (135) |
| Distillation, wt. % | | | |
| 215° C.− (420° F.−) | 0 | 0 | 0 |
| 215°-345° C. (420-650° F.) | 0 | 7.20 | 2.09 |
| 345°-455° C. (650-850° F.) | 54.02 | 60.85 | 58.99 |
| 455°-580° C. (850-1075° F.) | 34.73 | 28.33 | 36.26 |
| 580° C.+ (1075° F.+) | 11.25 | 3.62 | 2.66 |
| P/N/A Composition, wt % | | | |
| Paraffins | 31 | 52 | 81 |
| Aromatics | 49 | 15 | 10 |
| Naphthene | 20 | 33 | 9 |

Note
*Less than

The results are given in Tables 10-12 below, the reported pour points being for the 345° C.+ (650° F.+) fractions.

TABLE 10

| FCC of HVGO-C | | | | |
|---|---|---|---|---|
| Example | | 5 | 6 | 7 |
| Catalyst | Feed | De-Al Y | Beta (1) | Quartz |
| WHSV | | 10.2 | 9.9 | 4.5 |
| 215° C.+ Conv. | | 45.42 | 20.49 | 3.60 |
| 345° C.+ Conv. | | 72.86 | 36.08 | 13.13 |
| C1 + C2 | | 1.54 | 0.74 | 1.10 |
| C3 + C4 | | 7.58 | 3.10 | .10 |
| C5-215° C. | | 36.33 | 16.65 | 1.53 |
| 215°-345° C. | | 23.85 | 12.66 | 9.41 |
| 345°-455° C. | 54.02 | 18.83 | 41.84 | 57.90 |
| 455°-580° C. | 34.73 | 5.64 | 16.98 | 22.20 |
| 580° C.+ | 11.25 | 2.67 | 5.10 | 6.80 |
| Coke | | 3.56 | 2.93 | 0.99 |
| Dist. Selec. | | 32.70 | 35.10 | 71.70 |
| G/D | | 1.52 | 1.32 | 0.26 |
| Pour Pt, °C. (°F.)(2) | 32 (90) | 13 (55) | 13 (55) | 13 (55) |

Note
(1) Acid washed to 250:1 silica:alumina
Pour point of 650° F.+ fraction

TABLE 11

| FCC of HVGO-D | | | | |
|---|---|---|---|---|
| Example | | 8 | 9 | 10 |
| Catalyst | Feed | De-Al Y | Beta (1) | Quartz |
| WHSV | | 9.6 | 10.5 | 5.0 |
| 215° C.+ Conv. | | 65.02 | 29.92 | 1.23 |
| 345° C.+ Conv. | | 82.10 | 52.14 | 6.08 |
| C1 + C2 | | 2.23 | 0.66 | .13 |
| C3 + C4 | | 17.46 | 8.97 | |
| C5-215° C. | | 45.33 | 20.29 | .16 |
| 215°-345° C. | 7.20 | 14.48 | 25.00 | 11.61 |
| 345°-455° C. | 60.85 | 10.17 | 32.04 | 67.98 |
| 455°-580° C. | 28.33 | 3.90 | 9.47 | 19.17 |
| 580° C.+ | 3.62 | 2.53 | 2.90 | |
| Coke | | 3.89 | 0.67 | 0.94 |
| Dist. Selec. | | 9.55 | 36.80 | 72.50 |
| G/D | | 6.23 | 1.14 | 0.04 |
| Pour Pt,* °C. (°F.) | 43 (110) | 33 (92) | 27 (80) | 43 (110) |

TABLE 12

| FCC of HVGO-E | | | | |
|---|---|---|---|---|
| Example | | 11 | 12 | 13 |
| Catalyst | Feed | De-Al Y | Beta (1) | Quartz |

TABLE 12-continued

| FCC of HVGO-E | | | | |
|---|---|---|---|---|
| Example | | 11 | 12 | 13 |
| WHSV | | 13.0 | 10.2 | 5.0 |
| 215° C.+ Conv. | | 69.00 | 69.15 | 2.34 |
| 345° C.+ Conv. | | 77.30 | 78.17 | 4.08 |
| C1 + C2 | | 0.81 | 1.72 | 0.18 |
| C3 + C4 | | 11.45 | 25.45 | |
| C5-215° C. | | 54.67 | 41.98 | 0.42 |
| 215°-345° C. | 2.09 | 8.77 | 7.68 | 3.74 |
| 345°-455° C. | 58.99 | 15.27 | 12.92 | 57.49 |
| 455°-580° C. | 36.26 | 6.27 | 6.21 | 36.29 |
| 580° C.+ | 2.66 | 0.69 | 2.18 | 0.12 |
| Coke | 0.00 | 2.07 | 1.80 | 1.74 |
| Dist. Selec. | | 8.82 | 7.30 | 41.40 |
| G/D | | 8.18 | 7.51 | 0.25 |
| Pour Pt,* °C. (°F.) | 57 (135) | 54 (130) | 18 (65) | 49 (120) |

*Pour point of 650° F.+ fraction

Comparison of Table 10-12 shows that the dewaxing ability of the zeolite beta is related to the paraffin content of the feed. For relatively less waxy HVGO-C (31% paraffins) there is no improvement in the pour point of the 345° C.+ fraction, either by thermal cracking, cracking over the zeolite Y catalyst or over zeolite beta. As the paraffin content of the feeds increases in gas oils D and E (52 and 81% paraffins, respectively), so does the spread between the 345° C.+ pour points for the products obtained with the zeolite Y and the zeolite beta catalysts. Although product distillate selectivities for the two zeolites are similar, the possibility of extending the distillate end point above 345° C. by reason of the reduced pour point permits an increase in distillate selectivity for the zeolite beta to be achieved.

EXAMPLES 14-15

A steamed zeolite beta catalyst was used in these Examples with another waxy feed. The catalyst was prepared by the same method as in Examples 5-13 and used for cracking according to the same procedure as described there.

The properties of the waxy VGO feed used are shown in Table 13 below.

TABLE 13

| VGO Feed | |
|---|---|
| API Gravity | 33.4 |
| Pour Point, °C. (°F.) | 40 (105) |
| KV @ 40° C. cSt | 9.55 |
| KV @ 100° C., cSt | 2.74 |
| CCR | 0.05 |
| Aniline Pt, °C. (°F.) | 92.5 (198.50) |
| C, wt % | 86.10 |
| H, wt % | 13.76 |
| S, wt % | 0.13 |
| N ppmw | 140 |
| Simulated Distillation: wt % | |
| 215° C.− | 1.46 |
| 215° C.-345° C. | 29.40 |
| 345° C.-455° C. | 61.71 |
| 455° C.-540° C. | 7.43 |
| 540° C.+ | 0 |
| P/N/A: wt % | |
| Paraffins | 56.8 |
| Naphthenes | 14.8 |
| Aromatics | 29.4 |

The results of the cracking of the waxy VGO feed at two different severities are shown in Table 14 below, the pour point being of the 345° C.+ (650° F.+) fractions.

TABLE 14

| FCC of Waxy VGO Feed | | |
|---|---|---|
| Example | 14 | 15 |
| Catalyst | Beta | Beta |
| Temp, °C. (°F.) | 445 (835) | 505 (941) |
| Zeolite/Oil, wt | 0.49 | 0.88 |
| Catalyst/Oil, wt | 0.49 | 0.88 |
| 345° C.-Conversion, wt % | 54.1 | 79.5 |
| Pour Pt. 215° C.+, °C. (°F.) | (70) | (50) |
| Pour Pt. 345° C.+, °C. (°F.) | 29 (85) | 18 (65) |

These results show that the zeolite beta effectively dewaxes the high boiling function with increasingly lower pour point being obtained at higher conversions.

EXAMPLES 16–19

Gas oil D was cracked in a fixed bed at 500° C. (925° F.) over an REY cracking (12% REY on silica-alumina) catalyst and a steamed zeolite beta cracking catalyst, prepared by the same method as in Examples 5–13. The LFO (230°–365° C., 450°–690° F.) distillate yield and cetane index were determined at two different conversion levels for each catalyst. The results are shown in Table 15 below.

TABLE 15

| FCC of HVGO-D | | | | |
|---|---|---|---|---|
| Example | Catalyst | 345° C.+ Conversion | LFO Yield, vol. % | Cetane No. |
| 16 | REY | 50.1 | 25.5 | 45.8 |
| 17 | REY | 57.6 | 21.1 | 41.4 |
| 18 | Beta | 52.3 | 21.3 | 43.1 |
| 19 | Beta | 55.5 | 22.3 | 42.3 |

The distillates from the beta catalyst are of similar cetane quality to those from REY.

EXAMPLES 20–30

Cracking experiments were carried out with two different gas oils to demonstrate the effect of using high cracking temperatures. The compositions of the oils are shown in Table 16 below.

TABLE 16

| Feedstock Properties | | |
|---|---|---|
| Property | Paraffinic Gas Oil F | Paraffinic Gas Oil G |
| Hydrogen, wt pct. | 13.76 | 13.28 |

TABLE 16-continued

| Feedstock Properties | | |
|---|---|---|
| Property | Paraffinic Gas Oil F | Paraffinic Gas Oil G |
| Sulfur, wt pct. | 0.13 | 0.03 |
| Nitrogen, ppmw | 140 | 100 |
| Paraffins, wt pct. | 56.80 | 81.00 |
| Naphthenes, wt pct. | 14.80 | 9.00 |
| Aromatics, wt pct. | 28.40 | 10.00 |
| API Gravity | 33.40 | 35.21 |
| Pour Pt. °F. | +105 | +135 |
| TBP Boiling Range, | | |
| 5% @ °F. | 455 | — |
| 50% @ °F. | 717 | — |
| 95% @ °F. | 920 | — |
| Simulated Distillation, wt pct. | | |
| IBP-420° F. | 1.46 | 0.0 |
| 420–650° F. | 29.40 | 2.1 |
| 650°–850° F. | 61.71 | 59.0 |
| 850–1075° F. | 7.43 | 36.3 |
| 1075° F.+ | 0.0 | 2.7 |

The three gas oils identified above were subjected to catalytic cracking using three different catalysts whose identities are given in Table 17 below.

TABLE 17

| Properties of Cracking Catalysts | | | |
|---|---|---|---|
| Catalyst Desig. | (A) | (B) | (E) |
| Zeolite Component | REY | Beta | Ultra-STABLE Y |
| wt. pct. Zeolite | 12 | 100 | 100 |
| wt. pct. Matrix | 88 | — | — |
| Zeolite alpha | 8 | 12 | 5 |
| Catalyst Pretreatment | TCC Equil Catalyst | Steamed | Steamed |
| Steaming Severity | | | |
| Temp., °F. | TCC cond | 1200 | 1200 |
| Press, psia | TCC cond | 29.4 | 29.4 |
| % Steam | TCC cond | 100 | 100 |
| Duration | TCC cond | 24 | 24 |

The results of cracking the highly paraffinic Gas Oil F with the two catalysts are given below in Table 18.

TABLE 18

| Cracking Gas Oil F at 510° C. | | | | | | |
|---|---|---|---|---|---|---|
| Example | 20 | 21 | 22 | 23 | 24 | 25 |
| Catalyst | Zeolite Beta | Zeolite Beta | Zeolite Beta | Ultra-Stable Y | Ultra-Stable Y | Ultra-Stable Y |
| Catalyst I.D. | (B) | (B) | (B) | (E) | (E) | (E) |
| Cat/Oil, g/g | 0.88 | 0.94 | 2.86 | 0.89 | 1.25 | 1.79 |
| Zeolite/Oil g/g | 0.88 | 0.94 | 2.86 | 0.89 | 1.25 | 1.79 |
| Conversion to $C_4$- | 9.83 | 9.55 | 38.13 | 14.18 | 11.58 | 22.20 |
| Yields, wt. pct. | | | | | | |
| $C_1 + C_2$ | 0.94 | 1.07 | 1.63 | 1.64 | 1.48 | 1.66 |
| $C_3$· | 0.44 | 0.35 | 1.99 | 0.87 | 1.11 | 1.20 |
| $C_3$= | 4.57 | 4.66 | 17.45 | 6.59 | 0.83 | 9.30 |
| i-$C_4$ | 0.69 | 0.33 | 4.47 | 1.55 | 3.26 | 3.00 |
| n-$C_4$ | 0.18 | 0.12 | 0.94 | 0.63 | 0.45 | 0.50 |
| 1-Butene | 0.50 | 0.52 | 2.10 | 0.63 | 0.91 | 1.41 |
| Isobutene | 1.58 | 1.50 | 5.42 | 1.14 | 1.71 | 2.52 |
| 2-Butenes | 0.93 | 1.00 | 4.13 | 1.13 | 1.83 | 2.61 |
| Isobutene/$C_4$- | 0.16 | 0.15 | 0.14 | 0.08 | 0.14 | 0.11 |
| Isobutene/($C_1 + C_2$) | 1.68 | 1.40 | 3.33 | 0.69 | 0.86 | 1.51 |
| $C_3$ = i-$C_4$ + i-$C_4$ =, wt pct. | 6.8 | 6.5 | 27.34 | 9.28 | 5.80 | 14.82 |

The results in Table 18 show that there is a significant increase in the proportion of isobutene produced with the zeolite beta cracking catalyst as compared to the USY catalyst.

Similar results were obtained with cracking Gas Oil F at 505° C. with the REY catalyst (A) and the zeolite beta catalyst (B) as reported in Table 19 below.

TABLE 19

| Cracking Gas Oil F at 505° C. | | |
|---|---|---|
| Example | 26 | 27 |
| Catalyst | REY in | Zeolite |
| $SiO_2$—$Al_2O_3$ | Beta | |
| Catalyst I.D. | (A) | (B) |
| Cat/Oil, g/g | 7.50 | 1.05 |
| Zeolite/Oil, g/g | 0.87 | 1.05 |
| Conversion to $C_4$— | 12.8 | 34.4 |
| Yields, wt. pct. | | |
| $C_1 + C_2$ | 1.0 | 3.00 |
| $C_3$° | 0.30 | 1.50 |
| $C_3$= | 5.40 | 11.40 |
| i-$C_4$ | 1.40 | 4.00 |
| n-$C_4$ | 0.20 | 1.30 |
| 1-Butene | 0.80 | 2.10 |
| Isobutene | 1.90 | 9.10 |
| 2-Butenes | 1.80 | 2.00 |
| Isobutene/$C_4$— | 0.15 | 0.26 |
| Isobutene/($C_1 + C_2$) | 1.90 | 3.03 |
| $C_3 = + i - C_4+$ i-$C_4$ =, wt pct. | 8.7 | 24.5 |

At lower reaction severity (cat/oil ratio) the zeolite beta catalyst converts substantially more of the gas oil to the desired $C_4$— products than the REY catalyst despite the comparable alpha values for the two catalysts.

Gas Oil G was also subjected to cracking at 510° C. using the zeolite beta and the USY catalysts with the results given in Table 20 below.

TABLE 20

| Cracking Gas Oil G at 510° C. | | | |
|---|---|---|---|
| Example | 28 | 29 | 30 |
| Catalyst | Zeolite Beta | Ultra-Stable Y | Ultra-Stable Y |
| Catalyst I.D. | (B) | (E) | (E) |
| Cat/Oil, g/g | 1.18 | 0.92 | 1.22 |
| Zeolite/Oil, g/g | 1.18 | 0.92 | 1.22 |
| Conversion to $C_4$— | 27.17 | 12.26 | 27.90 |
| Yields, wt. pct. | | | |
| $C_1 + C_2$ | 0.77 | 0.77 | 1.71 |
| $C_3$° | 1.12 | 0.71 | 1.86 |
| $C_3$= | 12.85 | 5.82 | 13.39 |
| i-$C_4$ | 2.18 | 1.56 | 4.42 |
| n-$C_4$ | 0.54 | 0.26 | 0.72 |
| 1-Butene | 1.57 | 0.66 | 1.26 |
| Isobutene | 4.75 | 1.27 | 2.84 |
| 2-Butenes | 3.39 | 1.21 | 1.69 |
| Isobutene/$C_4$— | 0.17 | 0.10 | 0.18 |
| Isobutene/($C_1 + C_2$) | 6.16 | 1.65 | 1.66 |
| $C_3 = + i - C_4+$ i-$C_4$ =, wt pct. | 19.78 | 8.65 | 20.65 |

Again, there is a significant advantage for the zeolite beta catalyst in terms of the iso-butene production.

EXAMPLES 31–32

The effect of process severity on the yields of isobutene and $C_4$— was found by catalytically cracking Gas Oil F at 450° C. and 505° C. using the zeolite beta catalyst. The results are in Table 21 below.

TABLE 21

| Effect of Process Severity on Cracking Gas Oil G | | |
|---|---|---|
| Example | 31 | 32 |
| Catalyst | Zeolite Beta | Zeolite Beta |
| Temperature, °C. | 450 | 505 |
| Catalyst I.D. | (B) | (B) |

TABLE 21-continued

| Effect of Process Severity on Cracking Gas Oil G | | |
|---|---|---|
| Example | 31 | 32 |
| Cat/Oil, g/g | 0.5 | 1.05 |
| Zeolite/Oil, g/g | 0.5 | 1.05 |
| Conversion to $C_4$— | 13.3 | 32.8 |
| Yields, wt. pct. | | |
| $C_1 + C_2$ | 1.50 | 3.00 |
| $C_3$° | 0.60 | 1.50 |
| $C_3$= | 3.80 | 11.40 |
| i-$C_4$ | 1.70 | 4.00 |
| n-$C_4$ | 0.40 | 1.10 |
| 1-Butene | 0.70 | 2.10 |
| Isobutene | 3.00 | 9.10 |
| 2-Butenes | 1.60 | 0.60 |
| Isobutene/$C_4$— | 0.22 | 0.28 |
| Isobutene/($C_1 + C_2$) | 2.00 | 3.03 |
| $C_3 = i - C_4+$ i-$C_4$ =, wt pct. | 8.5 | 24.5 |

These results show the desirability of using cracking temperatures above 500° C. for maximum iso-butene production; it is noted that isobutene selectivity increases with increasing temperature.

We claim:

1. A process for improving the gasoline yield and octane rating of the gasoline boiling range ($C_5$—330° F.) product produced by the catalytic cracking of a highly paraffinic feedstock and alkylation of the iso-butene fraction produced in the cracking to produce an improved quantity of gasoline boiling range hydrocarbons comprising catalytically cracked gasoline and alkylate, which comprises:
   (i) contacting a feedstock having an initial boiling point above about 345° C. and comprising at least 40 weight percent paraffins with a circulating cracking catalyst comprising zeolite beta which includes no metal components in excess of 1000 ppmw at a temperature over 500° C. and in the absence of added hydrogen at a pressure of not more than 1000 kPa and a catalyst:oil ratio of 0.1:1–10:1 by weight to produce cracking products at conversion to lower boiling product of at least 50 weight percent, the cracking products including gasoline, butene and iso-butene;
   (ii) separating the cracking products;
   (iii) continuously regenerating the catalyst on a cyclic basis by oxidative removal of the carbon deposited on the cracking catalyst during the cracking;
   (iv) separating the cracking products to form a fraction containing an enhanced quantity of iso-butene, a gasoline boiling range fraction and a low pour point fraction boiling above the gasoline fraction;
   (v) producing alkylate from the iso-butene fraction to form an improved yield of a high octane rating alkylate fraction.

2. A process according to claim 1 in which the feedstock comprises at least 60 wt. % paraffinic components.

3. A process according to claim 1 in which the catalyst comprises 5 to 95 wt. % zeolite beta.

4. A process according to claim 1 in which the zeolite beta has a silica:alumina ratio of 15:1 to 150:1.

5. A process according to claim 1 in which the zeolite beta has an alpha activity of 1 to 500.

6. A process according to claim 1 in which the catalytic cracking process comprises a fluidized catalytic cracking process.

7. A process according to claim 1 in which the catalytic cracking process comprises a moving, gravitating bed catalytic cracking process.

8. A process according to claim 1 in which the zeolite beta comprises the sole zeolite cracking component in the catalyst.

9. A process according to claim 1 in which the oil is contacted with the catalyst at a temperature of at least 550° C.

10. A process according to claim 1 in which the cracking catalyst includes a carbon monoxide oxidation promotor as a metal component in an amount from 0.1 to 1000 ppmw.

11. A process according to claim 10 in which the oxidation promotor is present in an amount of 0.1 to 100 ppmw.

12. A process according to claim 1 in which the conversion to lower boiling products is 50 to 90 weight percent.

13. A process according to claim 1 in which the octane rating of the gasoline and alkylate is at least 90 (R+O).

* * * * *